US009791875B1

(12) United States Patent
Wang

(10) Patent No.: US 9,791,875 B1
(45) Date of Patent: Oct. 17, 2017

(54) SELF-REFERENCED LOW-DROPOUT REGULATOR

(71) Applicant: NXP USA, Inc., Austin, TX (US)

(72) Inventor: Ge Wang, Chandler, AZ (US)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 15/399,418

(22) Filed: Jan. 5, 2017

(51) Int. Cl.
*G05F 1/575* (2006.01)

(52) U.S. Cl.
CPC ..... *G05F 1/575* (2013.01)

(58) Field of Classification Search
CPC ..... G05F 1/56; G05F 1/562; G05F 1/575
USPC ..... 323/273, 274
See application file for complete search history.

(56) References Cited

U.S. PATENT DOCUMENTS

| | | | | |
|---|---|---|---|---|
| 6,518,737 | B1 * | 2/2003 | Stanescu | G05F 1/575 323/280 |
| 9,529,374 | B2 * | 12/2016 | Enjalbert | G05F 1/575 |
| 9,553,548 | B2 * | 1/2017 | Park | H03F 1/26 |
| 9,651,968 | B2 * | 5/2017 | Pujol | G05F 1/625 |
| 9,671,804 | B2 * | 6/2017 | Kronmueller | G05F 1/575 |
| 2005/0248331 | A1 * | 11/2005 | Whittaker | G05F 1/575 323/313 |
| 2013/0265020 | A1 * | 10/2013 | Krenzke | G05F 1/56 323/273 |
| 2016/0018834 | A1 * | 1/2016 | Kronmueller | G05F 1/468 323/280 |
| 2016/0026204 | A1 | 1/2016 | De Cremoux | |

FOREIGN PATENT DOCUMENTS

EP 2977849 A1 1/2016

OTHER PUBLICATIONS

Bontempo, G. "Low quiescent current, ULDO linear regulator", IEEE International Conference on Electronics, Circuits and Systems, vol. 1., 409-412 pgs. (2001).
Wang, H. "A CMOS Low-Dropout Regulator With New Compensation Method", International Conference on Solid-State and Integrated Circuit Technology Proceedings, 1508-1510 pgs. (2006).

* cited by examiner

*Primary Examiner* — Jeffrey Sterrett
(74) *Attorney, Agent, or Firm* — Rajeev Madnawat

(57) ABSTRACT

A low dropout regulator (LDO) is disclosed. The LDO includes a transistor loop including a first transistor coupled to a second transistor. The first transistor and the second transistor coupled to a first resistor and a second resistor. The first resistor being coupled to ground and second resister coupled to the first resistor. The LDO further includes an output transistor coupled to the second transistor and a power supply line. The output transistor further coupled to a pair of input transistors coupled to the power supply line. One of the input transistors coupled to a third resistor, wherein the third resistor coupled to a fourth resistor and the fourth resistor coupled to ground. The LDO also includes a fifth resistor coupled to an output of the output transistor. The fifth resistor is coupled to the first transistor.

6 Claims, 1 Drawing Sheet

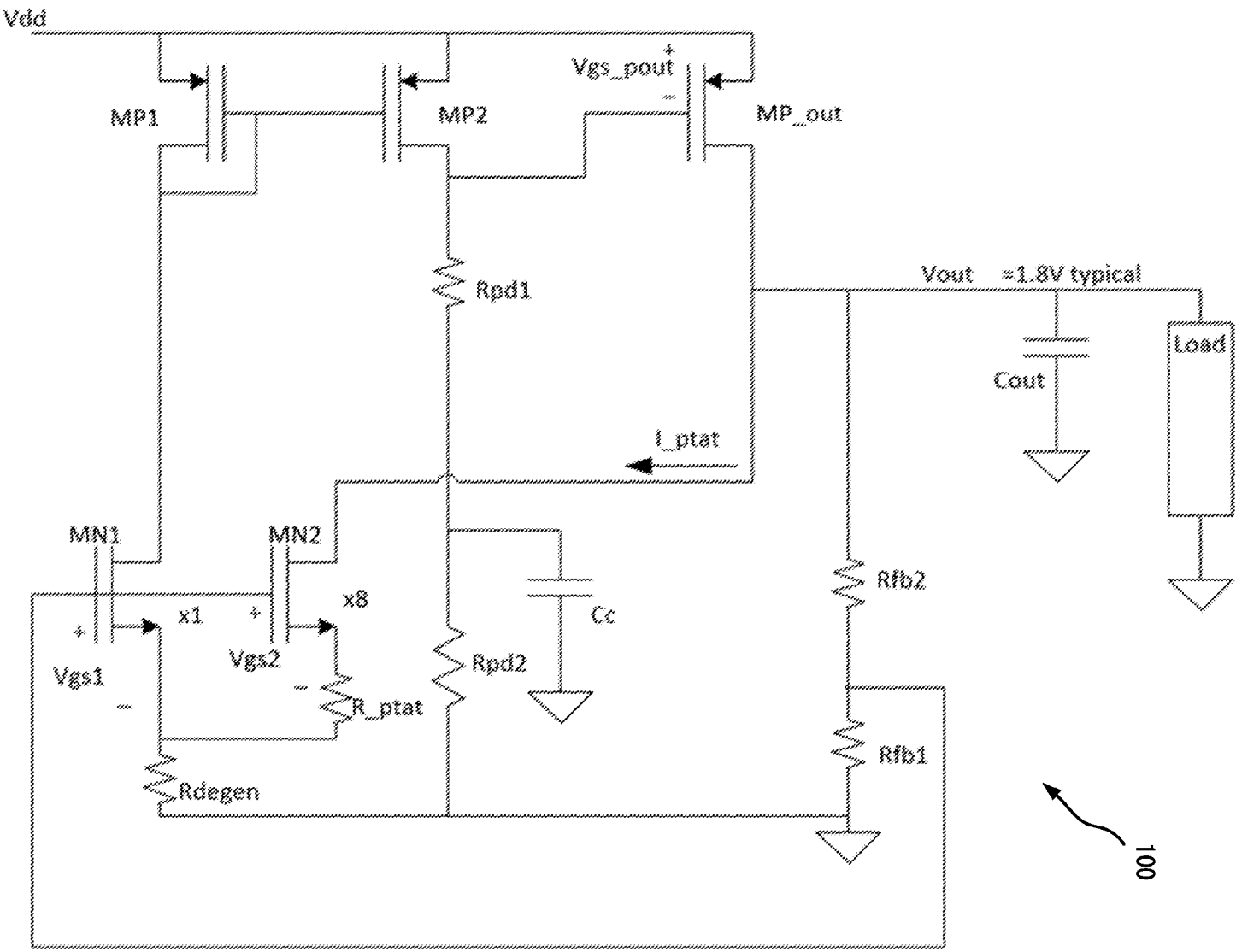
100
Load
Cout
Vout =1.8V typical
Rfb2
Rfb1
MP_out
Vgs_pout
I_ptat
Cc
Rpd1
Rpd2
MP2
R_ptat
x8
MN2
Vgs2
x1
Rdegen
MP1
MN1
Vgs1
Vdd

SELF-REFERENCED LOW-DROPOUT REGULATOR

BACKGROUND

A low-dropout regulator (LDO) is a DC linear voltage regulator that can regulate the output voltage even when the supply voltage is very close to the output voltage. Existing LDOs typically need a reference voltage, a biasing current a high quiescent current for its normal operation. Such LDOs do not work in conditions where there is no external reference voltage, no biasing current and very low quiescent power requirement. The advantages of a low dropout voltage regulator over other DC to DC regulators include the absence of switching noise (as no switching takes place), smaller device size (as neither large inductors nor transformers are needed), and greater design simplicity (usually consists of a reference, an amplifier, and a pass element).

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, low dropout regulator (LDO) is disclosed. The LDO includes a transistor loop including a first transistor coupled to a second transistor. The first transistor and the second transistor coupled to a first resistor and a second resistor. The first resistor being coupled to ground and second resister coupled to the first resistor. The LDO further includes an output transistor coupled to the second transistor and a power supply line. The output transistor further coupled to a pair of input transistors coupled to the power supply line. One of the input transistors coupled to a third resistor, wherein the third resistor coupled to a fourth resistor and the fourth resistor coupled to ground. The LDO also includes a fifth resistor coupled to an output of the output transistor. The fifth resistor is coupled to the first transistor.

In some embodiment, the third resistor is coupled to the ground through a first capacitor. The LDO further includes a sixth resistor coupled to the ground and the first resistor. The value of the first resistor is determined based on a current between the output transistor to the second transistor and the value of the second resistor is determined to keep the predetermined level of the current between the output transistor and the second resistor.

In some embodiments, the width of the second transistor is bigger than the width of the first transistor. In some examples the width of the second transistor is between 4 to 12 times the width of the first transistor.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. Advantages of the subject matter claimed will become apparent to those skilled in the art upon reading this description in conjunction with the accompanying drawings, in which like reference numerals have been used to designate like elements, and in which:

FIG. 1 depicts a schematic circuit diagram of an improved self-referenced low dropout regulator in accordance with one or more embodiments of the present disclosure.

Note that figures are not drawn to scale. Intermediate steps between figure transitions have been omitted so as not to obfuscate the disclosure. Those intermediate steps are known to a person skilled in the art.

DETAILED DESCRIPTION

Many well-known manufacturing steps, components, and connectors have been omitted or not described in details in the description so as not to obfuscate the present disclosure.

This disclosure describes an improved self-referenced low dropout (LDO) voltage regulator. In some examples, this LDO can be used regulating voltage of the supply for on-chip digital logic circuit. In one example, the LDO operating quiescent current is roughly typical 1 uA. It does not need external reference voltage and external biasing current. Its input voltage range can be from 5V to 1.8V while its output voltage range is required to 1.8V typical.

In certain special operating situations, such that when a device is entering power save mode, the on-chip bandgap reference voltage is not available. Existing LDOs fail to perform properly due to the lack of the reference voltage during such operating conditions. A bandgap voltage reference is a temperature independent voltage reference circuit widely used in integrated circuits. The bandgap voltage reference produces a fixed (constant) voltage regardless of power supply variations, temperature changes and circuit loading from a device. In some examples, it commonly has an output voltage around 1.25 V (close to the theoretical 1.22 eV bandgap of silicon at 0 K).

The improved LDO described herein continues to supply power for the digital logic circuit of our whole chip when the chip power supply system is available and bandgap voltage is ready.

In some applications such as chips for mobile devices, a digital watchdog timer function is incorporated in the circuit in a chip. The digital watchdog timer is used to alarm and reset a system including multiple chips. The digital watchdog timer starts to work when the main power and functions of the chip are disabled and/or disconnected. Hence, the only power supply available during such condition is from a charge-holding capacitor. Since capacitors take large space on a chip, to keep chip and device sizes smaller, such capacitors are typically smaller.

To keep the digital watchdog timer to operate for a long time (several seconds), it is desired to design a low-power and self-sustained LDO to provide a required output voltage (e.g., 1.8V). During this operation period, there is not any reference voltage and biasing current are shut down to save power. In addition, the LDO described herein also regulates the power supply during normal operations of the device or chip.

In on-chip circuit development, it is sometimes necessary to create a voltage that is directly proportional to temperature, or proportional to absolute temperature (PTAT). The PTAT is an essential building block of a voltage reference that is constant over temperature. Temperature independent references are used in on-chip circuit designs for functions such as bias circuits and data converter references voltage sources. For example, a voltage reference is typically designed using a PTAT voltage summed with a voltage that is complementary to absolute temperature (CTAT). The summation of the two voltages will be constant over temperature if the temperature coefficients are chosen to cancel.

FIG. 1 depicts a schematic circuit diagram of an improved self-referenced low dropout regulator (LDO) 100. The LDO 100 includes transistors MN1, MN2, MP1, MP2 and MP_out. In some embodiments, transistors MN1 and MN2 are of type NMOS and transistors MP1, MP2 and MP_out are of type PMOS. The LDO 100 also includes capacitors Cc and Cout that may simply be provided for ground couplings. The LDO 100 may also include resistors R_ptat, Rdgen, Rpd1, Rpd2, Rfb1 and Rfb2. The gate to source voltage Vgs1 of the transistor MN1 initially acts to be the built-in reference voltage. Resistors Rfb1, Rfb2 and Rfb3 forms the resistor feedback network. When the LDO 100 is in normal operation (e.g., a device in which the LDO 100 is being used is powered up and in the normal operating mode), the output voltage Vout is regulated, without considering the impact of the resistor Rdegen, as follows:

$$Vout=Vgs1*[(Rfb1+Rfb2)/Rfb1]$$

As evident, voltage Vgs1 is the reference voltage of the LDO 100. The typical overall Vgs1 of the transistor MN1 is designed to be at the proximity of the transistor MN1's threshold voltage (Vth1), which is a CTAT (Contrary To Absolute Temperature) voltage. Hence, the output voltage Vout is a CTAT voltage.

To compensate this CTAT trend in order to make the output voltage Vout as flat as possible over temperature, a PTAT (proportional To Absolute Temperature) voltage to compensate the CTAT Vgs1 is needed. Therefore, transistors MN1, MN2 and the resistor R_ptat are provided to generate a PTAT current which goes to the resistor Rdegen to generate a PTAT voltage. In some embodiments, the width of the transistor MN2 is 'n' (shown as x8 in FIG. 1) times that of the width of the transistor MN1, while their length is kept the same. The value of 'n' may be in the range of 4 to 12 in some embodiments. However, in other embodiments, the value may also be 1.

By utilizing very small quiescent currents, Vgs1 of the transistor MN1 is kept very close to its threshold voltage Vth1. Vgs2 of the transistor MN2 is also kept very close to its threshold voltage Vth2.

$$Vgs1\approx Vth2.$$

$$Vgs2\approx Vth2.$$

The PTAT current can be calculated as follows, $$Iptat=((Vgs1-Vgs2))/(R_ptat)\approx((Vth1-Vth2))/(R_ptat)$$

The PTAT voltage on the resistor Rdegen is, $$Vptat=Rdegen*(((Vgs1-Vgs2))/(R_ptat))$$

By selecting an appropriate value of the resistor Rdegen based on the value of I_ptat, the PTAT voltage can help to keep the Vout relatively constant over temperature.

The final output voltage is calculated as follows, $$Vout=(Vgs1+Vptat)*((Rfb1+Rfb2))/Rfb1=>Vout\approx(Vth1+Rdegen*((Vth1-Vth2))/(Rptat))*((Rfb1+Rfb2))/Rfb1$$

The I_ptat current is tied and sent to the output transistor pmos MP_out. The purpose is to give the transistor MP_out a small minimum operating current so that the transistor MP_out will never run at zero current to prevent the feedback to collapse. In some examples, the LDO operating quiescent current is roughly typical 1 uA. And no additional reference voltage and additional biasing current is not needed.

Some or all of these embodiments may be combined, some may be omitted altogether, and additional process steps can be added while still achieving the products described herein. Thus, the subject matter described herein can be embodied in many different variations, and all such variations are contemplated to be within the scope of what is claimed.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

Preferred embodiments are described herein, including the best mode known to the inventor for carrying out the claimed subject matter. Of course, variations of those preferred embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

What is claimed is:

1. A low dropout regulator (LDO), comprising:

a transistor loop including a first transistor coupled to a second transistor, wherein the first transistor and the second transistor are coupled to a first resistor and a second resistor, the first resistor being coupled to ground and the second resistor is coupled to the first resistor;

an output transistor is coupled to the second transistor and a power supply line, wherein the output transistor is further coupled to a pair of input transistors that are coupled to the power supply line, wherein one of the input transistor is coupled to a third resistor, wherein the third resistor is coupled to a fourth resistor and the fourth resistor is coupled to ground; and a fifth resistor is coupled to an output of the output transistor, wherein the fifth resistor is coupled to the first transistor.

2. The LDO of claim 1, wherein the third resistor is coupled to ground through a first capacitor.

3. The LDO of claim 1, further including a sixth resistor coupled to ground and the first resistor.

4. The LDO of claim 1, wherein a value of the first resistor is determined based on a current between the output transistor and the second transistor.

5. The LDO of claim 4, wherein a value of the second resistor is determined to keep a predetermined level of current between the output transistor and the second resistor.

6. The LDO of claim 1, wherein a width of the second transistor is between 4 to 12 times a width of the first transistor.

* * * * *